US010463130B2

(12) United States Patent
Zjiroecha

(10) Patent No.: US 10,463,130 B2
(45) Date of Patent: Nov. 5, 2019

(54) HAIR STYLING DEVICE

(71) Applicant: KONINKLIJKE PHILIPS N.V., Eindhoven (NL)

(72) Inventor: Nikolaj Vasiljevitsj Zjiroecha, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/767,381

(22) PCT Filed: Nov. 14, 2016

(86) PCT No.: PCT/EP2016/077514
§ 371 (c)(1),
(2) Date: Apr. 11, 2018

(87) PCT Pub. No.: WO2017/089152
PCT Pub. Date: Jun. 1, 2017

(65) Prior Publication Data

US 2018/0295961 A1 Oct. 18, 2018

(30) Foreign Application Priority Data

Nov. 25, 2015 (EP) ..... 15196218

(51) Int. Cl.

| | |
|---|---|
| ***A45D 1/28*** | (2006.01) |
| ***A45D 2/00*** | (2006.01) |
| ***A45D 1/04*** | (2006.01) |
| *A45D 20/00* | (2006.01) |

(52) U.S. Cl.
CPC ..... *A45D 1/28* (2013.01); *A45D 1/04* (2013.01); *A45D 2/001* (2013.01); *A45D 20/00* (2013.01)

(58) Field of Classification Search
CPC ... A45D 1/02; A45D 1/04; A45D 1/28; A45D 2/001; A45D 2/367; A45D 20/00
USPC ..... 219/225
See application file for complete search history.

(56) References Cited

U.S. PATENT DOCUMENTS

| | | | | |
|---|---|---|---|---|
| 5,349,160 | A * | 9/1994 | Hazan | D06F 75/26 219/245 |
| 5,857,379 | A * | 1/1999 | Lulofs | A45D 20/00 132/212 |
| 6,026,821 | A * | 2/2000 | Last | A45D 20/12 132/200 |
| 6,138,376 | A | 10/2000 | Garfinkel | |
| 8,707,969 | B2 | 4/2014 | Seng | |
| 2007/0267037 | A1 | 11/2007 | Hur | |
| 2009/0159093 | A1 | 6/2009 | Yu | |

(Continued)

FOREIGN PATENT DOCUMENTS

| | | |
|---|---|---|
| CN | 102960931 A | 3/2013 |
| CN | 202890918 U | 4/2013 |

(Continued)

*Primary Examiner* — Tatiana L Nobrega

(57) ABSTRACT

A hair styling device comprises a heating contact surface (HP) for applying heat to hair; a temperature sensor (TS) for sensing a hair temperature; and a control circuit to control a heating of the heating contact surface (HP) in such a manner that a first temperature setting that applies when hair is wet, does not exceed a threshold temperature, the threshold temperature not exceeding 120° C., while a second temperature setting of at least 140° C. applies when the hair is not wet.

5 Claims, 1 Drawing Sheet

(56) References Cited

U.S. PATENT DOCUMENTS

| | | | | |
|---|---|---|---|---|
| 2010/0089413 | A1 | 4/2010 | Wright | |
| 2011/0253164 | A1* | 10/2011 | Morgandi | A45D 1/28 132/211 |
| 2012/0024311 | A1* | 2/2012 | Linglin | A45D 1/04 132/232 |
| 2012/0055501 | A1* | 3/2012 | Seng | A45D 1/28 132/211 |
| 2012/0291797 | A1* | 11/2012 | deGrood | A45D 1/28 132/211 |
| 2012/0312320 | A1* | 12/2012 | Humphreys | A45D 1/04 132/211 |
| 2013/0152958 | A1* | 6/2013 | Lee | A45D 1/04 132/205 |
| 2013/0247407 | A1 | 9/2013 | Richmond | |
| 2015/0173480 | A1* | 6/2015 | Washington | A45D 2/001 132/206 |
| 2015/0313339 | A1* | 11/2015 | Moore | A45D 1/04 132/224 |
| 2015/0335120 | A1* | 11/2015 | Moore | A45D 1/04 132/211 |
| 2016/0007707 | A1* | 1/2016 | Carter | A45D 1/20 132/229 |
| 2016/0353854 | A1* | 12/2016 | Thomas | A45D 19/16 |

FOREIGN PATENT DOCUMENTS

| | | | |
|---|---|---|---|
| EP | 2272391 | A1 | 1/2011 |
| EP | 2524617 | A2 | 11/2012 |
| WO | 2014098334 | A1 | 6/2014 |

* cited by examiner

HAIR STYLING DEVICE

This application is the U.S. National Phase application under 35 U.S.C. § 371 of International Application No. PCT/EP2016/077514, filed on Nov. 14, 2016, which claims the benefit of International Application No. 15196218.0 filed on Nov. 25, 2015. These applications are hereby incorporated by reference herein.

FIELD OF THE INVENTION

The invention relates to a hair styling device.

BACKGROUND OF THE INVENTION

US 2012/0291797 discloses a hair styling apparatus that includes a hair-heating device for applying heat to hair. The hair-heating device has a dry-temperature setting, and a moisture-temperature setting that is higher than the corresponding low-temperature setting. The following exemplary look-up tables are disclosed:

TABLE 1

| moisture-temperature setting (° C.) | dry-temperature setting (° C.) |
|---|---|
| 235 | 190 |
| 220 | 190 |
| 200 | 190 |
| 180 | 170 |
| 160 | 150 |

TABLE 2

| moisture-temperature setting (° C.) | dry-temperature setting (° C.) |
|---|---|
| 230 | 190 |
| 210 | 190 |
| 190 | 180 |
| 170 | 160 |
| 150 | 140 |

US 2012/0312320 discloses a hair tool for styling hair, the hair tool having at least one heatable element, and a temperature regulator associated with the heatable element to control the temperature of the heatable element. If the hair tool is placed on the hair and the temperature decreases, the hair tool can be programmed to determine that the hair is wet and that a greater temperature is required. At that point, the hair tool sets the heating plates to reach, for example, a temperature of about 275° F. (about 135° C.).

U.S. Pat. No. 8,707,969 discloses a hair treatment device having a heating element that is heated to a starting temperature and whose temperature is regulated by a temperature control. The hair treatment device has a sensor that measures data from which a parameter based on the condition of the hair can be generated, wherein the parameter influences the temperature control. Nothing is said about the level of this starting temperature.

SUMMARY OF THE INVENTION

It is, inter alia, an object of the invention to provide an improved hair styling device. The invention is defined by the independent claims. Advantageous embodiments are defined in the dependent claims.

According to a first aspect of the invention, a hair styling device comprises a heating contact surface (for applying heat to hair; a temperature sensor for sensing a hair temperature; and a control circuit to control a heating of the heating contact surface in such a manner that a first temperature setting that applies when hair is wet, does not exceed a threshold temperature, the threshold temperature not exceeding 120° C., while a second temperature setting of at least 140° C. applies when the hair is not wet.

Embodiments of this invention provide a hair styling device that is suitable both for drying and styling of hair and can be used for wet as well for dry hair. Conventional straighteners usually operating in the temperature range from 130° C. to 220° C. The invention is based on the insight that if such high temperatures are used by the straightener on wet hair, irreversible damage will be caused to the hair fiber surface, caused by the micro explosions during the transition phase of water.

In view thereof, aspects of the present invention aim at providing a straightener that can be used on both wet and dry hair which will mitigate the problem that the hair is damaged when wet hair is handled by the straightener. Embodiments are based on the insight that wet hair could be heated up to 110° C. without causing heat damage to the hairs. That means that for drying of the hairs with the straightener both the hair and the heating plate temperature must have comparable temperature that is around 105+/−5° C., because at lower hair temperature the drying of hair will take too much time, therefore more styling strokes will be required to dry the hair.

For straightening, a much higher hair temperature is required, to be able to create a temporary style by modifying the shape/texture of hair by removing loosely/weaker hydrogen bonds, so that the hair needs to be at quasi-stable stage at the temperatures around 140-150° C. (depends on hair type, hair amount, moisture content and potential damage level). So the maximum straightening time at those temperatures will be around 10-15 minutes. Higher straightening temperatures>150° C. can alternatively be used, to achieve faster straightening results, but then the exposure time should be much-much lower, depending on the plate temperature. Because the inner layer of hair or cortex get flattened at about 150° C., the straightening temperature range is preferably set between 140 and 150° C.

Preferably, to ensure that both temperature ranges are achieved both for drying as well for straightening of hairs, a very accurate temperature measurement is used. Preferably, the hair temperature is measured directly and not as it is usually done by measuring the temperature of the heating plate. One way to achieve that is to use a direct contact measuring method or a thermistor. For that the heating plates are preferably equipped with two thermistors, both positioned on one of the heating plates. To reduce the risk of damage to the hair structure, the hair temperature preferably does not exceed 110° C. during drying, so that the required accuracy of sensors is preferably better than 5° C.

These and other aspects of the invention will be apparent from and elucidated with reference to the embodiments described hereinafter.

DESCRIPTION OF EMBODIMENTS

Figure 1:
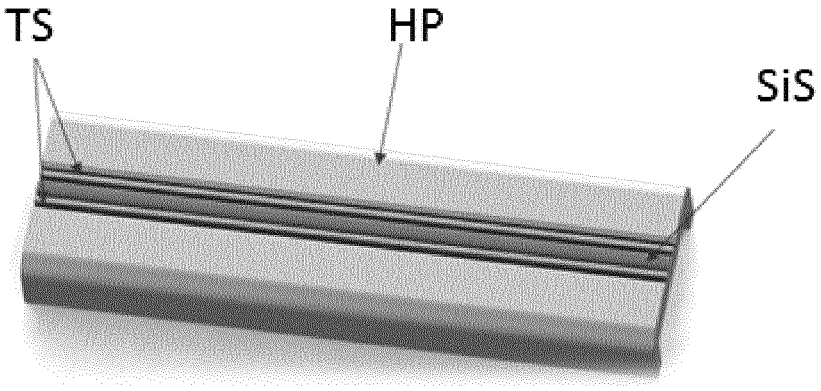
FIGS. 1 and 2 show embodiments of a heating strip for use in a hair styling device of the present invention.

FIG. 1 shows a first embodiment of a heating contact surface for use in a hair styling device (e.g. a hair straightener) of the present invention. In this embodiment, the heating contact surface is formed by a heating plate HP that is equipped with two temperature sensors TS formed by thermistors strips for measuring the hair temperature, and a silicone strip SiS to increase the friction coefficient and therefore decreasing styling speed. As usual, the straightener may have two heating plates HP that face each other and between which the hair is clamped. Temperature is measured as absolute temperature in degrees Celsius. In the embodiment of FIG. 1, the location of the temperature sensors TS is in the middle of the surface of the heating plate HP, while in the embodiment of FIG. 2, the temperature sensors are located more at the edges of the heating plate HP. To ensure a good temperature measurement, it is important that the temperature sensor TS is in contact with the hair fibers.

The straightener has a control circuit (not shown) formed by a processor programmed by software that is written in such a way, that the straightener can recognize whether the hair is wet of dry. During the drying stage, the temperature both of the plate and of the hair should not exceed a temperature of 120° C., preferably 110° C., to reduce hair damage. The user needs, for example, to use the first 10 strokes to dry the hair and remove by the external moisture from the hair. Once the device senses that the hair temperature is reaching the temperature of 110° C., the software will automatically change the temperature setting of the heating plates HP to a higher temperature, for example 180° C., and continuously measure the hair temperature during styling strokes and stop the heating process only after the hair temperature has reached the equilibrium straightening temperature of 140-150° C. and if the plate temperature does not increase anymore during strokes. This allow to control the amount of moisture in the hair, and prevent irreversible damage to hair structure from occurring. This hair temperature is important because above this temperature of 150° C. strongly bonded water will be removed, and a hair transition stage will take place with a much higher risk of toughening transition (protein affected 87% hair fiber structure), hair may even get yellow and therefore this protein damage can be considered as severe permanent/non-reversible damage. The only thing that a user needs do is to switch off the device after usage. The straightener could also give a haptic or audible feedback to help the user that the straightening process is finished, once the required hair temperature is achieved.

Figure 2:
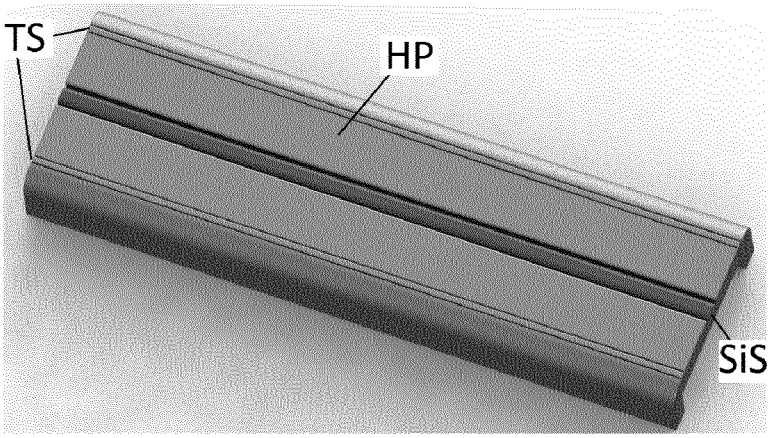

To improve conductive heat transfer from the heating plates to the hairs, the styling speed must be lowered (reduce required straightening strokes). In the embodiments of FIGS. 1 and 2, this is achieved in that the heating plates HP are equipped with at least one silicone strip SiS that will increase the friction coefficient between hairs and heating plate HP and therefore result in a slower stroke speed. Also it is important to mention that the straightened effect that will be achieved here is temporally and can be reversed by environmental factors such as water that is used during washing cycle(s), rain, humidity, etc.

It should be noted that the above-mentioned embodiments illustrate rather than limit the invention, and that those skilled in the art will be able to design many alternative embodiments without departing from the scope of the appended claims. The hair styling device may alternatively use a moisture sensor to determine whether the hair is still wet, instead of relying on the hair temperature sensor. The heating contact surface may be curved instead of a heating plate. The control circuit to control the temperature setting may include dedicated circuitry like relays instead of a suitably programmed processor.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A hair styling device comprising:

a heating contact surface having a perimeter defined by opposing proximal and distal edges and opposing first and second lateral edges, wherein a longitudinal length of the heating contact surface is the distance between the opposing proximal and distal edges, said heating contact surface comprising:

a silicon strip substantially centered within the heating contacting surface and extending substantially along an entirety of said longitudinal length;

a first temperature sensor configured to measure a first temperature of hair in contact with said heating contact surface;

a second temperature sensor configured to measure a second temperature of the hair in contact with said heating contact surface:

a heating means configured to heat said heating contact surface; and, a controller configured to:

iteratively receive said first and second temperatures of the hair;

determine a wet or dry condition of the hair based on said received first and second temperatures of the hair;

control heating of said heating contact surface via said heating means based on the determined wet or dry condition of the hair;

wherein, i) said controller determines a wet condition exists when said first and second temperatures are below 110° C. and when a wet condition is determined, said heating contact surface is heated to a first temperature setting of 110° C.; ii) said controller determines a dry condition exists when said first and second temperatures are at or above said first temperature setting and when said dry condition is determined, said heating contact surface is heated to a second temperature setting of at least 140° C. and iii) said controller turns off said heating means to stop the heating process after said received first and second temperatures of the hair have reached an equilibrium straightening temperature of 140-150° C. and if a temperature of said heating contact surface does not increase during strokes.

2. The hair styling device of claim 1, wherein said first temperature sensor comprises at least one temperature sensor positioned on a first side of said silicone strip and said second temperature sensor comprises at least one temperature sensor positioned on a second side of said silicone strip, said first side and said second side being on opposite sides of said silicone strip.

3. The hair styling device of claim 2, wherein said first temperature sensor is positioned adjacent to said silicone strip and said second temperature sensor is positioned adjacent to said silicone strip.

4. The hair styling device of claim 2, said first temperature sensor is positioned along said first lateral edge of the heating contact surface and said second temperature sensor is positioned along said second lateral edge of the heating contact surface.

5. The hair styling device of claim 1, wherein the first temperature sensor and the second temperature sensor are thermally isolated from the heating contact surface.

* * * * *